US006695717B2

(12) United States Patent
Morgan et al.

(10) Patent No.: US 6,695,717 B2
(45) Date of Patent: Feb. 24, 2004

(54) ALL RUBBER GOLF BALL WITH HOOP-STRESS LAYER

(75) Inventors: William E. Morgan, Barrington, RI (US); Roman D. Halko, San Diego, CA (US); Emanuel Vieira, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/386,081

(22) Filed: Mar. 12, 2003

(65) Prior Publication Data

US 2003/0171164 A1 Sep. 11, 2003

Related U.S. Application Data

(62) Division of application No. 09/842,829, filed on Apr. 27, 2001.

(51) Int. Cl.[7] ..... A63B 37/06

(52) U.S. Cl. ..... 473/360; 473/361; 473/362

(58) Field of Search ..... 473/360, 361, 473/362, 356

(56) References Cited

U.S. PATENT DOCUMENTS

| | | | | |
|---|---|---|---|---|
| 4,431,193 | A | 2/1984 | Nesbitt | 273/235 R |
| 4,938,471 | A | 7/1990 | Nomura et al. | 273/227 |
| 5,002,281 | A | 3/1991 | Nakahara et al. | 273/220 |
| 5,072,944 | A | 12/1991 | Nakahara et al. | 273/220 |
| 5,334,673 | A | 8/1994 | Wu | 473/378 |
| 5,713,801 | A | 2/1998 | Aoyama | 473/354 |
| 5,913,736 | A | 6/1999 | Maehara et al. | 473/360 |
| 5,919,100 | A | 7/1999 | Boehm et al. | 473/354 |
| 5,993,968 | A | 11/1999 | Umezawa et al. | 428/407 |
| 6,030,296 | A | 2/2000 | Morgan et al. | 473/361 |

*Primary Examiner*—Mark S. Graham
*Assistant Examiner*—Thanh Duong
(74) *Attorney, Agent, or Firm*—Swidler Berlin Shereff Friedman, LLP

(57) ABSTRACT

The invention includes a golf ball having a core, a hoop-stress layer of high tensile elastic modulus material wrapped or wound about the core, at least one outermost layer of a thermoset material having a thickness of greater than about 0.065 inches. A binding material can be used in conjunction with the hoop-stress layer to facilitate positioning of the hoop-stress layer around the core for easier manufacturing.

20 Claims, 1 Drawing Sheet

ALL RUBBER GOLF BALL WITH HOOP-STRESS LAYER

This application is a divisional of U.S. patent application Ser. No. 09/842,829, filed Apr. 27, 2001, now pending, which is incorporated in its entirety by reference herein.

FIELD OF THE INVENTION

This invention relates generally to golf balls, and more specifically, to a golf ball having a hoop-stress layer within a layered rubber construction. In particular, it is directed to a golf ball having multiple layers including a center of at least one layer of a resilient elastomeric material, a hoop-stress layer including at least one material with a tensile elastic modulus of at least about 10,000 kpsi, and an outermost layer of a thermosetting material. The golf balls of the present invention can provide decreased spin and improved resiliency for better distance, as well as maintaining the "soft" feel of a traditional wound ball.

BACKGROUND OF THE INVENTION

Until recently, golf balls were typically divided into two general types or groups: 1) two piece balls and 2) wound balls (also known as three piece balls). The difference in play characteristics resulting from these different types of constructions can be quite significant.

Balls having a two piece construction are generally most popular with the recreational golfer because they provide a very durable ball while also providing maximum distance. Two piece balls are made with a single solid core, usually formed of a crosslinked rubber, which is encased by a cover material. Typically the solid core is made of polybutadiene which is chemically crosslinked with zinc diacrylate and/or similar crosslinking agents. The cover comprises tough, cut-proof blends of one or more materials known as ionomers such as SURLYN®, which are resins sold commercially by DuPont or IOTEK® which is sold commercially by Exxon.

The combination of the above-described core and cover materials provides a "hard" covered ball that is resistant to cutting and other damage caused by striking the ball with a golf club. Further, such a combination imparts a high initial velocity to the ball which results in increased distance. Due to their hardness however, these balls have a relatively low spin rate which makes them difficult to control, particularly on shorter approach shots. As such, these types of balls are generally considered to be "distance" balls. Because these materials are very rigid, many two piece balls have a hard "feel" when struck with a club. Softer cover materials such as balata and softer ionomers in some instances, have been employed in two piece construction balls in order to provide improved "feel" and increased spin rates.

Wound balls typically have either a solid rubber or fluid center around which many yards of a tensioned elastic thread, typically polyisoprene, are wrapped to form a wound core. The wound core is then covered with a durable cover material such as a SURLYN®, or similar material, or a softer cover such as balata. A wound material layer differs from a solid layer in that the wound layer is often able to more readily elongate and compress in a direction lateral to the impacting force. For this reason, wound golf balls have a tendency to more easily compress at impact and have more spin, as compared to a solid golf ball (Dalton, Golf and Science III, 1999), which enables a skilled golfer to have more control over the ball's flight. In particular, it is desirable that a golfer be able to impart back spin to a golf ball for purposes of controlling its flight and controlling the action of the ball upon landing on the ground. For example, substantial back spin will make the ball stop once it strikes the landing surface instead of bounding forward. The ability to impart back spin onto a golf ball is related to the extent to which the golf ball cover deforms when it is struck with a golf club. Because wound balls are traditionally more deformable than conventional two piece balls, it is easier to impart spin to wound balls. However, wound higher spinning balls typically travel a shorter distance when struck as compared to a two piece ball. Moreover, as a result of their more complex structure, wound balls generally require a longer time to manufacture and are more expensive to produce than a two piece ball.

Therefore, golf ball manufacturers are continually searching for new ways in which to provide golf balls that deliver the maximum performance in terms of both distance and spin rate for golfers of all skill levels.

Golf ball designs have been introduced which use multilayer non-wound constructions in an effort to overcome some of the undesirable aspects of conventional two piece balls and wound balls, while maintaining the positive attributes of these golf balls (including their increased initial velocity and distance). These include double cover designs with solid, single member cores; dual core designs with two core members and a single cover layer; and balls with multiple core and/or multiple cover layers.

A number of patents have been issued directed towards modifying the properties of a conventional two piece ball by altering the typical single layer core and/or single cover layer construction to provide a multilayer core and/or cover. The inventions disclosed in these patents are directed towards improving a variety of golf ball characteristics.

One technique suggested in the prior art to avoid the problem of an overly hard stiff cover was disclosed in U.S. Pat. No. 4,431,193 issued to Nesbitt. Rather than have a single layer cover over the core, the cover would be molded in two layers: a hard stiff inner layer of a high flexural modulus material that provides significant hoop stress, surrounded by a soft, flexible outer cover of a lower flexural modulus material of approximately 14 kpsi. Balls of this design have been sold bearing the Strata name for some time, however, because of the inner layer thickness of about 0.045 inches to 0.050 inches and the high flexural modulus of greater than 50,000 psi, the golf balls have a hard feel to which many golfers object.

U.S. Pat. No. 5,072,944 discloses a three-piece solid golf ball having a center and outer layer which are prepared from a rubber composition, preferably having a base rubber of polybutadiene. This patent teaches that it is desirable that the center core is softer than the outer layer, wherein the layers have a hardness (Shore C) of 25–50 and 70–90 respectively.

U.S. Pat. No. 5,002,281 is directed towards a three-piece solid golf ball which has an inner core having a hardness of 25–70 (Shore C) and an outer shell having a hardness of 80–95 (Shore C), wherein the specific gravity of the inner core must be greater than 1.0, but less than or equal to that of the outer shell, which must be less than 1.3.

Additionally, several patents have been issued which employ a wound layer of high tensile elastic modulus material, thus replacing the need for a cover providing the necessary hoop-stress in a golf ball.

U.S. Pat. No. 5,713,801 issued to Aoyama teaches a method for making a golf ball providing a core of solid resilient material, winding a high elastic modulus fiber on the core to create a first wound layer to form a "hoop-stress layer," and molding an outer layer of resilient material about the first wound layer. The core in the above method and apparatus may also be made of a center wound with a low modulus fiber and provided with an initial tension. The preferred cover materials are ionomer and balata.

U.S. Pat. No. 5,913,736 issued to Maehara et al. builds upon Aoyama to describe a hoop-stress layer made of a shape memory alloy (Ti—Ni) wound around a core so as to provide a shaped memory alloy layer.

SUMMARY OF THE INVENTION

The golf ball of the present invention has three or more concentrically disposed layers, including: a core, preferably polybutadiene, of at least one layer formed of at least one resilient elastomeric material; a hoop-stress layer including at least one material, preferably wire, thread, or filament, under a tensile elastic modulus of at least about 10,000 kpsi, preferably at least about 20,000 kpsi, wound or wrapped about the core; and an outermost thermoset material of at least one layer disposed about the hoop-stress layer and having a thickness of greater than about 0.065 inches.

The material forming the hoop-stress layer is preferably a continuous strand of diameter ranging from about 0.004 to 0.04 inches. The material can be glass, aromatic polyamids, carbon, metals, shape memory alloys, natural fibers, or a combination thereof and can be wound or wrapped in a criss-cross, basket weave, or open pattern about the core. When wound or wrapped, the material can include a plurality of braided elements.

The outermost thermoset material includes at least one of polybutadiene, natural rubber, styrene butadiene rubber, isoprene, or mixtures thereof and a hardness from about 10 to 90 Shore D. In one embodiment, the outermost thermoset material includes polybutadiene. The outermost layer can have a thickness of 0.065 inches, preferably 0.08 inches, and most preferably 0.1 inches. The outermost layer can include an abrasion resistant material.

In one embodiment, the golf ball further includes a second resilient elastomeric material of at least one layer disposed between the hoop-stress layer and the outermost thermoset material.

The first resilient elastomeric material and the outermost thermoset material can each comprise polybutadiene. In one embodiment, the polybutadiene used in the first resilient elastomeric material and the outermost thermoset material is the same. Another embodiment of the invention is a golf ball having four or more concentrically disposed layers, including: a core of at least one layer formed from a resilient elastomeric material; an outermost thermoset material of at least one layer, having a thickness greater than about 0.065 inches, preferably greater than about 0.08 inches, disposed about the second resilient elastomeric material of at least one layer; and hoop-stress layer formed from at least one wound material with a tensile elastic modulus of at least about 10,000 kpsi, preferably at least about 20,000 kpsi, disposed between the core and the outermost thermoset material, wherein the at least one material forming the hoop-stress layer has a first cross-sectional area and is coated with a binding material layer to create a second cross-sectional area greater than the first.

In this aspect of the invention, the material forming the hoop-stress layer can be a continuous strand of diameter ranging from about 0.004 to about 0.04 inches.

The binding material can include at least one of thermoplastic polyvinyl butyral, thermoplastic epoxy, thermoplastic polyester phenolic, thermoplastic polyamide, thermosetting adhesive epoxy, thermoplastic polyamide-imide, or combinations thereof. The second cross-sectional area is preferably at least about 5 percent larger than the first cross-sectional area.

The outermost thermoset material includes at least one of polybutadiene, natural rubber, and styrene butadiene rubber, isoprene, or mixtures thereof.

BRIEF DESCRIPTION OF THE DRAWINGS

Further features and advantages of the invention can be ascertained from the following detailed description which is provided in connection with the attached drawings, wherein.

DEFINITIONS

Figure 1:
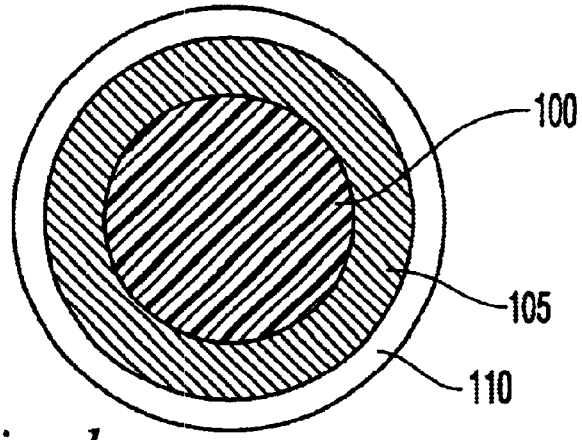
FIG. 1 illustrates a cross-section of a multilayer golfball with at least one center resilient elastomeric layer and a hoop-stress layer in accordance with the present invention.

The term "about," as used herein in connection with one or more numbers or numerical ranges, should be understood to refer to all such numbers, including all numbers in a range.

As used herein, the term "thermoset" material refers to an irreversible, solid polymer that is the product of the reaction of two or more prepolymer precursor materials.

As used herein, the term "multilayer" means at least three layers and includes balls with at least one center layer, a hoop-stress layer, and at least one outermost layer.

As used herein, the term "fluid" includes a liquid, a paste, a gel, a gas, or any combination thereof.

As used herein, "cis-to-trans catalyst," means any component or a combination thereof that will convert at least a portion of cis-isomers to trans-isomers in polybutadiene at a given temperature.

As used herein, the term "parts per hundred", also known as "phr", is defined as the number of parts by weight of a particular component present in a mixture, relative to 100 parts by weight of the total polymer component. Mathematically, this can be expressed as the weight of an ingredient divided by the total weight of the polymer, multiplied by a factor of 100.

As used herein, the term "molecular weight" is defined as the absolute weight average molecular weight. The molecular weight is determined by the following method: approximately 20 mg of polymer is dissolved in 10 mL of tetrahydrofuran ("THF"), which may take a few days at room temperature depending on the polymer's molecular weight and distribution. One liter of THF is filtered and degassed before being placed in a high-performance liquid chromatography ("HPLC") reservoir. The flow rate of the HPLC is set to 1 mL/min through a Viscogel column. This non-shedding, mixed bed, column model GMHHR-H, which has an ID of 7.8 mm and 300 mm long is available from Viscotek Corp. of Houston, Tex. The THF flow rate is set to 1 mL/min for at least one hour before sample analysis is begun or until stable detector baselines are achieved. During this purging of the column and detector, the internal temperature of the Viscotek TDA Model 300 triple detector should be set to 40° C. This detector is also available from Viscotek Corp. The three detectors (i.e., Refractive Index, Differential Pressure, and Light Scattering) and the column should be brought to thermal equilibrium, and the detectors should be purged and zeroed, to prepare the system for calibration according to the instructions provided with this equipment. A 100-$\mu$L aliquot of sample solution can then be injected into the equipment and the molecular weight of each sample can be calculated with the Viscotek's triple detector software. When the molecular weight of the polybutadiene material is measured, a dn/dc of 0.130 should always be used. It should be understood that this equipment and these methods provide the molecular weight numbers described and claimed herein, and that other equipment or methods will not necessarily provide equivalent values as used herein.

As used herein the term "resilience index" is defined as the difference in loss tangent measured at 10 cpm and 1000 cpm divided by 990 (the frequency span) multiplied by 100,000 (for normalization and unit convenience). The loss tangent is measured using an RPA 2000 manufactured by Alpha Technologies of Akron, Ohio. The RPA 2000 is set to sweep from 2.5 to 1000 cpm at a temperature of 100° C. using an arc of 0.5 degrees. An average of six loss tangent measurements were acquired at each frequency and the average is used in calculation of the resilience index. The computation of resilience index is as follows:

Resilience Index=100,000·[(loss tangent@10 cpm)−(loss tangent@1000 cpm)]/990

As used herein, the term "substantially free" means less than about 5 weight percent, preferably less than about 3 weight percent, more preferably less than about 1 weight percent, and most preferably less than about 0.01 weight percent.

DETAILED DESCRIPTION OF THE INVENTION

It has now been discovered that the use of a hoop-stress layer in combination with an all rubber golf ball, according to the present invention, thereby permits a golf ball construction having no traditional cover without sacrificing the performance benefits of a typical "hard" cover ball formed of one or more thermoplastic materials.

Without being limited to any particular theory, it is believed that with low club head speed and high loft shots such as those made with an high-numbered iron or a sand wedge, a ball's surface hardness has a greater influence on the ball's flight characteristics than the ball's overall construction. Thus, all other parameters being equal, a ball with a softer outermost layer will have a higher spin rate than one with a harder surface when struck with an iron or a wedge, regardless of the ball's overall construction. In contrast, when a golf ball is struck with a high club head speed and a low loft angle, such as that of a driver, the overall construction of the ball has a greater influence on the ball's flight characteristics than does the surface hardness.

The present invention advantageously provides a golf ball that returns to shape post-impact thus preventing permanent deformation of the ball, even in the absence of a traditional cover. In most conventional golf balls, one or more layers of a cover of such balls is stiffer than the core materials. Conventional covers provide durability, as well as providing protection for the inner materials. In contrast, the present invention uses a hoop-stress layer formed of a wound, high tensile elastic modulus material, such as a thread, fiber, filament, or wire, to provide the necessary hoop-stress in a golf ball, thus permitting construction of a golf ball with different types of cover compositions. This wound high tensile elastic modulus layer can be incorporated within one or more layers of a solid multilayer core, wherein the innermost layer(s) of the core are very soft and subject to high deflections upon impact with a golf club, or simply be wound or wrapped around a single layer core. In addition, a binding material can coat the hoop-stress layer so that the layer will remain properly positioned around the core or core of the golf ball.

The golf ball of the invention is believed to provide a further benefit for a golfer's short game. The spin of a ball after being struck with a large force, such as with a driver, is controlled by the relationship between the softness (flexibility) of the outermost layer and the compressibility of the core of the golf ball. When the impact force is low, such as in the short game, the resulting spin of a golf ball is controlled almost entirely by surface (outermost layer) hardness. A softer outermost layer is desired by golfers to improve short game spin, however, it also increases driver spin and decreases distance. To some extent, softening the core can reduce the driver spin of soft-covered balls, but if both the outermost layer and the core are too soft, the golf ball loses resiliency and the resulting initial velocity and distance that are also desired in a golf ball. Therefore, golf ball manufacturers are challenged with making a soft outermost layer golf ball with low driver spin, which the present invention advantageously provides.

Thus, improved golf balls can be prepared according to the invention by: (a) providing a resilient elastomeric core of at least one layer; (b) winding or wrapping a hoop-stress layer of high tensile elastic modulus material about the core; (c) surrounding the hoop-stress layer with at least one outermost layer formed including a thermoset material; and optionally, (d) coating the material with a first cross-sectional area forming the hoop-stress layer to create a second cross-sectional area greater than the first before applying the outermost layer. The hoop-stress layer and the thickness of the outermost thermoset layer are critical to the performance of the golf balls of the present invention.

In one embodiment, shown in FIG. 1, a unitary golf ball core 100 is surrounded by a hoop-stress layer 105 of a high tensile elastic modulus filament of at least 10,000 kpsi. This hoop-stress layer is surrounded by at least one outermost layer including a thermoset material 110.

Figure 2:
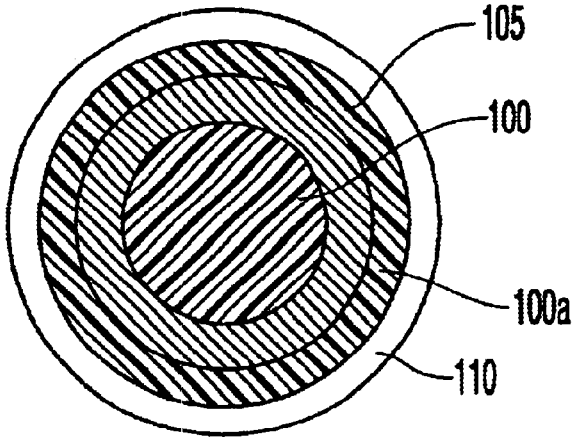
FIG. 2 illustrates a cross-section of a multilayer golf ball with a plurality of center resilient elastomeric layers and a hoop-stress layer disposed therebetween in accordance with an embodiment of the present invention.

In a second embodiment, shown in FIG. 2, a golf ball core includes a core 100 surrounded by a hoop-stress layer 105 of a high tensile elastic modulus of at least 10,000 kpsi. This hoop-stress layer is surrounded by an intermediate resilient elastomeric material 100A, which in turn is protected by an outermost thermoset material layer 110. In an alternate second embodiment, the core is at least two layers 100 and 105, e.g., two solid layers or a fluid center contained by an encapsulating shell. The hoop-stress layer 100A surrounds the core layers and a thermoset layer 110 is applied to the hoop-stress layer to form a golf ball.

Figure 3:
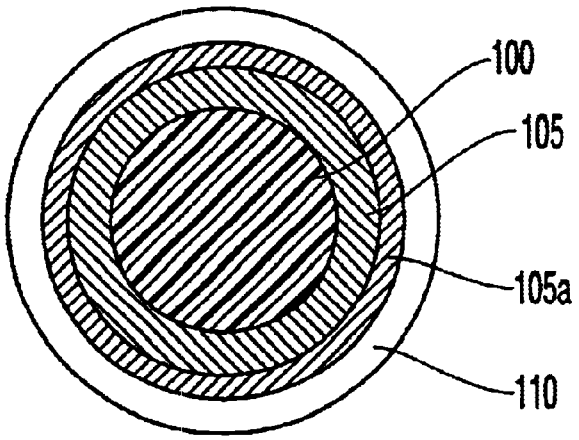
FIG. 3 illustrates a cross-section of a multilayer golf ball with a hoop-stress layer and a binding material in accordance with an embodiment of the present invention.

In a third embodiment of the invention, shown in FIG. 3, the filament forming the hoop-stress layer is coated with a binding material to ensure repeatable proper positioning of the hoop-stress layer during manufacturing. A hoop-stress layer 105 is wound or wrapped about the core 100, or in an embodiment not shown, the hoop-stress layer is situated between an innermost core layer and an intermediate resilient elastomeric material. The filament of hoop-stress layer 105 is coated with a binding material 105A that will adhere to the core and itself when activated. In another embodiment (not shown), the binding material coats a portion of the filament without forming a separate layer. An outermost thermoset material of at least one layer 110 surrounds the inner components of the ball.

The Cores

The golf ball cores of the present invention may comprise any of a variety of constructions. For example, the core of the golf ball may comprise a conventional core surrounded by a hoop-stress layer disposed between the core and the outermost thermoset layer. The core may be a single layer or may include a plurality of layers.

The solid core is typically a homogenous mass of a resilient material having a base rubber, a crosslinking agent, a filler, and a co-crosslinking or initiator agent. The base rubber typically includes one or more natural or synthetic rubbers. A preferred base rubber is 1,4-polybutadiene having a cis-structure of at least 40%. If desired, the polybutadiene can also be mixed with other elastomers known in the art such as natural rubber, polyisoprene rubber and/or styrene-butadiene rubber in order to modify the properties of the core.

Preferred commercial sources of polybutadiene include Shell 1220 manufactured by Shell Chemical, Neocis BR40 and BR60 manufactured by Enichem Elastomers, Ubepol BRI50 and 360 manufactured by Ube Industries, Ltd., CB23 manufactured by Bayer Corporation of Akron, Ohio, and BUDENE 1207G, manufactured by Goodyear. If desired, the polybutadiene can also be mixed with other elastomers known in the art, such as natural rubber, styrene butadiene, and/or isoprene in order to further modify the properties of the material. When a mixture of elastomers is used, the amounts of other constituents in the core composition are generally based on 100 parts by weight of the total elastomer mixture.

In one embodiment, the resilience index of the core is greater than about 40, preferably greater than about 45. In one preferred embodiment, the resilience index of the core is greater than about 50. The core compression can thus be reduced, thereby decreasing the overall spin rate of the ball without a significant loss in golf ball initial velocity. An exemplary finished ball velocity according to the present invention can advantageously be about 253.5 to 254.5 ft/s. These correspond to CORs of 0.812 and 0.818 respectively.

The crosslinking agent includes a metal salt of an unsaturated fatty acid such as a zinc salt or a magnesium salt of an unsaturated fatty acid having 3 to 8 carbon atoms such as acrylic or methacrylic acid. Suitable cross linking agents include metal salt diacrylates, dimethacrylates and monomethacrylates wherein the metal is magnesium, calcium, zinc, aluminum, sodium, lithium or nickel.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity in the USGA test. The zinc diacrylate can be of various grades of purity. For the purposes of this invention, the lower the quantity of zinc stearate present in the zinc diacrylate the higher the zinc diacrylate purity. Zinc diacrylate containing about 1 to 10 percent zinc stearate is preferable. More preferable is zinc diacrylate containing about 4 to 8 percent zinc stearate. Preferred commercially available zinc diacrylates include those from Rockland React-Rite and Sartomer. The preferred concentrations of zinc diacrylate that can be used are about 20 to 50 phr based upon 100 parts of polybutadiene or alternately, polybutadiene with a mixture of other elastomers.

Free radical initiators are used to promote cross-linking of the metal salt diacrylate, dimethacrylate, or monomethacrylate and the polybutadiene. Suitable free radical initiators for use in the invention include, but are not limited to, peroxide compounds. Exemplary peroxides include dicumyl peroxide, 1,1-di(t-butylperoxy) 3,3,5-trimethyl cyclohexane, a-a bis (t-butylperoxy)diisopropylbenzene, 2,5-dimethyl-2,5 di (t-butylperoxy)hexane, or di-t-butyl peroxide, and mixtures thereof. Other useful initiators will be readily apparent to one of ordinary skill in the art without any need for experimentation. The initiator(s) at 100% activity are preferably added in an amount ranging between about 0.05 and 2.5 phr based upon 100 parts of butadiene, or butadiene mixed with one or more other elastomers. More preferably, the amount of initiator added ranges between about 0.15 and 2 phr and most preferably between about 0.25 and 1.5 phr.

Many golf balls use fillers added to the elastomeric composition in the cores to adjust the density and/or specific gravity of the core. In a preferred embodiment, the golf balls of the present invention are substantially free of filler, or even completely free of added filler. As used herein, the term "fillers" includes any compound or composition that can be used to vary the density or other properties of a layer or portion of a golf ball. If needed, fillers useful in the golf ball according to the present invention include, for example, precipitated hydrated silica; clay; talc; glass fibers; aramid fibers; mica; calcium metasilicate; barium sulfate; zinc sulfide; lithopone; silicates; silicon carbide; diatomaceous earth; carbonates such as calcium carbonate and magnesium carbonate; metals such as titanium, tungsten, aluminum, bismuth, nickel, molybdenum, iron, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, magnesium oxide, and zirconium oxide; particulate carbonaceous materials such as graphite, carbon black, cotton flock, natural bitumen, cellulose flock, and leather fiber; micro balloons such as glass and ceramic; fly ash; and combinations thereof. The amount and type of filler utilized is governed by the amount and weight of other ingredients in the composition, since a maximum golf ball weight of 45.93 g (1.62 ounces) has been established by the United States Golf Association (USGA). Appropriate fillers generally used have a specific gravity from about 2 to 20. In one preferred embodiment, a filler having a specific gravity of about 12 to 20 can be included.

In one embodiment, the core is at least two layers, e.g., two solid layers or a fluid center contained by an encapsulating shell. The hoop-stress layer surrounds the core layers and a thermoset layer having a thickness greater than about 0.065 inches is formed around the hoop-stress layer to form a golf ball.

The cores employed in the golf balls of the present invention preferably have a diameter of about 1 inch to 1.6 inches, more preferably about 1.1 inches to 1.5 inches.

The cores of the present invention can be made by any suitable process available in the art. For example, the solid cores can be either injection or compression molded.

The Hoop-Stress Layer

The hoop-stress layer of the present invention has a-tensile modulus of at least about 10,000 kpsi and is formed of a high tensile "filament", which can be a filament, fiber, thread, or wire, preferably including glass, aromatic polyamids, carbon, metals, shape memory alloys, or natural fibers, or a combination or blend thereof. The hoop-stress layer is wound or wrapped about the core of one or more layers. In a more preferred embodiment, the hoop-stress layer has a tensile modulus of at least about 20,000 kpsi. If a hoop-stress layer is created using a high density material, such as a metal, the ball will typically have an increased moment of inertia, and thus will tend to spin less when struck with a golf club and yet retain its spin longer during flight. The use of high density materials in the hoop-stress layer can advantageously permit the fillers from other components of the golf ball to be reduced or removed while keeping the overall golf ball weight constant. Specifically, removing fillers from elastomeric components such as the resilient elastomeric material used as another layer of the ball can soften and increase resilience of the components and even the ball as a whole.

Any suitable winding or wrapping method known to those of ordinary skill in the art can be used to form the hoop-stress layer. Preferably, the hoop-stress layer is created winding strands in a criss-cross, basket weave, or open pattern, which requires fewer wraps than a great circle pattern and a less dense application to obtain spherical symmetry. The criss-cross pattern typically employs a fairly large lateral rotation during winding. One such suitable method is described in U.S. Pat. No. 4,938,471 to Nomura et al., wherein at least 8 turns of every ten turns of strands around the core have a crossing angle between two consecutive turns in the range of 12° to 45°. The hoop-stress layer can include multiple strands that are braided, or otherwise entwined, during the winding or wrapping process.

In one embodiment, a binding material preferably coats the material which forms the hoop-stress layer, such that the cross-sectional area of the coated hoop-stress layer is greater than the cross-sectional area of the wound layer alone. The binding material preferably causes the strands of the hoop-stress layer to swell so as to increase the cross-sectional area of each thread. This can advantageously permit repeatable proper positioning of the hoop-stress layer around the core or core of the golf ball. In a preferred embodiment, the binding material increases the cross-sectional area of the hoop-stress layer by at least about five (5) percent. In a preferred embodiment, the cross-sectional area can be increased by at least about ten (10) percent. The binding material can include one or more thermoset or thermoplastic materials. Preferably, the binding material includes thermoplastic polyvinyl butyral, thermoplastic epoxy, thermoplastic polyester phenolic, thermoplastic polyamide, thermosetting adhesive epoxy, thermoplastic polyamide-imide, or a combination thereof The binding material can be activated, for example, by heat, pressure, chemical or photo-activation, before, during, or after the winding process. The hoop-stress layers include one or more threads, but are preferably made of a single continuous strand with a diameter ranging from about 0.004 inches to 0.04 inches. The hoop-stress thread preferably includes one or more high specific gravity alloys.

Examples of suitable high specific gravity alloys are alloys that have specific gravities greater than about 7.6, which include steel, brass, bronze, copper, nickel, lead, titanium, gold, silver, and platinum. Exemplary alloys include steel, brass, and bronze as they provide the best combination of tensile strength (greater than about 250 $N/mm^2$) and high specific gravity (preferably ranging from about 7.6 to 10). While gold, silver, and platinum have higher specific gravities than other suitable alloys, they tend to be more expensive; copper and nickel have similar specific gravities as the exemplary alloys, but do not tend to provide comparable strength; and titanium is strong, but tends to have a lower specific gravity than steel.

The hoop-stress layers employed in the golf balls of the present invention preferably have a thickness from about 0.01 inches to 0.1 inches, more preferably about 0.02 inches to 0.08 inches. In one exemplary embodiment, the hoop-stress layer has a thickness of about 0.04 inches. The outer diameter of the hoop-stress layer is preferably from about 1.3 to about 1.63 inches.

The Outermost Thermoset Layer

The outermost thermoset layer is formed from a relatively soft thermoset material in order to replicate the soft feel and high spin play characteristics of a balata ball when the balls of the present invention are used for pitch and other "short game" shots. In particular, the outermost thermoset layer should have a Shore D hardness of from about 10 to 90, preferably from about 30 to 80, and most preferably from about 40 to 75. Additionally, the materials of the outermost thermoset layer must have a sufficient abrasion and cut resistance in order to be suitable for use as a golf ball cover.

The outermost thermoset layer of the present invention can include any suitable thermoset material. The preferred materials for the outermost thermoset layer include, but are not limited to, polybutadiene, natural rubber, styrene butadiene rubber, isoprene, or combinations thereof. In one more preferred embodiment, the outermost layer includes one or more of the polybutadienes described herein for use in the core.

If the outermost thermoset layer is too thick, this layer will contribute to the in-flight characteristics related to the overall construction of the ball and not the surface properties. If the outermost thermoset layer is too thin, however, it may not be durable enough to withstand repeated impacts by the golfer's clubs. Specifically, it has been determined that the outer cover layer should have a thickness of greater than about 0.065 inches, preferably greater than about 0.08 inches, and more preferably greater than about 01 inches.

The multi-layer golf ball of the invention can have an overall diameter of any size. Although the United States Golf Association specifications limit the minimum size of a competition golf ball to 1.68 inches in diameter or more, there is no specification as to the maximum diameter. Moreover, golf balls of any size can be used for recreational play. The preferred diameter of the present golf balls is from about 1.68 inches to 1.8 inches. The more preferred diameter is from about 1.68 inches to 1.76 inches. The most preferred diameter is about 1.68 inches to 1.7 inches.

It is to be understood that the invention is not to be limited to the exact configuration as illustrated and described herein. For example, it should be apparent that a variety of materials would be suitable for use in the composition or method of making the golf equipment according to the Detailed Description of the Preferred Embodiments. Accordingly, all expedient modifications readily attainable by one of ordinary skill in the art from the disclosure set forth herein, or by routine experimentation therefrom, are deemed to be within the spirit and scope of the invention as defined by the appended claims.

What is claimed is:

1. A method of making a golf ball, comprising the steps of:

providing a core;

providing a hoop-stress material having a tensile elastic modulus of about 10,000 kpsi or greater;

coating the hoop-stress material with a binding material to create a coated hoop-stress material;

wrapping the coated hoop-stress material about the core to create an inner ball; and forming a cover about the inner ball.

2. The method of claim 1, wherein the core comprises at least one resilient elastomeric material.

3. The method of claim 1, wherein the step of coating the hoop-stress material further comprises the step of:

activating the binding material by heat activating, pressure activating, chemical activating, photo activating, or a combination thereof.

4. The method of claim 1, wherein the step of forming a cover further comprises the step of:

providing a material selected from the group consisting of polybutadiene, natural rubber, styrene butadiene rubber, isoprene, and combinations thereof.

5. The method of claim 1, wherein the step of wrapping the coated hoop-stress material comprises the steps of:

providing a plurality of strands formed from the coated hoop-stress material; and braiding the plurality of strands during wrapping.

6. A method of making a golf ball, comprising the steps of:

providing a core;

providing a hoop-stress material having a tensile elastic modulus of about 10,000 kpsi or greater and a cross-sectional area;

coating the hoop-stress material with a binding material to create a coated hoop-stress material;

activating the coated hoop-stress material;

wrapping the coated hoop-stress material about the core to create an inner ball; and forming a cover about the inner ball.

7. The method of claim 6, wherein the step of coating the hoop-stress material further comprises the step of:

providing a binding material selected from the group consisting of thermoplastic polyvinyl butyral, thermoplastic epoxy, thermoplastic polyester phenolic, thermoplastic polyamide, thermosetting adhesive epoxy, thermoplastic polyamide-imide, and combinations thereof.

8. The method of claim 6, wherein the step of providing a hoop-stress material further comprises the step of:

selecting a hoop-stress material comprising a single strand having a diameter of about 0.004 inches to about 0.04 inches.

9. The method of claim 6, wherein the step of providing a hoop-stress material further comprises the step of:

providing a hoop-stress material comprising at least one high specific gravity alloys having a specific gravity of greater than about 7.6.

10. The method of claim 6, wherein the step of forming the cover further comprises the step of:

providing a material selected from the group consisting of polybutadiene, natural rubber, styrene butadiene rubber, isoprene, and combinations thereof; and forming a cover having a hardness of about 30 Shore D to about 80 Shore D.

11. The method of claim 6, wherein the step of activating increases the cross-sectional area of the inner ball by about 5 percent or greater.

12. The method of claim 6, wherein the step of wrapping comprises winding the hoop-stress material in a criss-cross pattern, a basket weave pattern, an open pattern, or a combination thereof.

13. A method of making a golf ball, comprising the steps of:

providing a core;

providing a hoop-stress material having a tensile elastic modulus of about 10,000 kpsi or greater and a cross-sectional area;

coating the hoop-stress material with a binding material to create a coated hoop-stress material;

wrapping the coated hoop-stress material about the core to create an inner ball; and forming a thermoset cover about the inner ball.

14. The method of claim 13, wherein the hoop-stress material has a tensile elastic modulus of about 20,000 kpsi or greater.

15. The method of claim 13, wherein the step of forming the thermoset cover comprises forming a cover having a thickness of about 0.065 inches or greater.

16. The method of claim 13, wherein the step of providing a hoop-stress material comprises selecting the hoop-stress material from the group consisting of glass, aromatic polyamide, carbon, metal, shape memory alloy, natural fiber, and mixtures thereof.

17. The method of claim 13, wherein the step of coating further comprises activating the binding material before the step of wrapping.

18. The method of claim 13, wherein the step of wrapping comprises the steps of:

wrapping the coated hoop-stress material about the core; and activating the binding material.

19. The method of claim 17, wherein the step of activating increases the cross-sectional area by about 5 percent or greater.

20. The method of claim 18, wherein the step of activating increases the cross-sectional area by about 5 percent or greater.

* * * * *